US006110415A

United States Patent [19]

Hickman et al.

[11] Patent Number: 6,110,415

[45] Date of Patent: Aug. 29, 2000

[54] DEVICE FOR OPENING FURNACE TAP HOLES

[75] Inventors: Raymond L. Hickman, Gilroy, Calif.; Gerald J. Madden, Pocatello, Id.; Marvin R. Hackett, Tracy, Calif.

[73] Assignee: FMC Corporation, Philadelphia, Pa.

[21] Appl. No.: 08/938,086

[22] Filed: Sep. 26, 1997

[51] Int. Cl.[7] ..... C21C 5/48

[52] U.S. Cl. ..... 266/271; 266/45

[58] Field of Search ..... 266/271, 45

[56] References Cited

U.S. PATENT DOCUMENTS

| | | | |
|---|---|---|---|
| 529,996 | 11/1894 | Baker | 266/271 |
| 3,190,629 | 6/1965 | Draper | 266/271 |
| 4,418,894 | 12/1983 | Mailliet | 266/45 |
| 4,602,770 | 7/1986 | Mailliet et al. | 266/271 |
| 5,192,489 | 3/1993 | Metz et al. | 266/271 |

*Primary Examiner*—Scott Kastler
*Attorney, Agent, or Firm*—John J. Elnitski, Jr.; Michael Lee; Patrick C. Baker

[57] ABSTRACT

The invention provides a remotely controlled furnace tap hole tapping system. The system is pneumatically driven and is able to tap holes placed at different heights, different positions, and different angles. The invention replaces an oxygen filled lance which is consumable, with a solid metal lance. The lance is carried by a carrier system, which moves long a track. The invention provides a gantry that is able to move the carrier system to different tracks. The pneumatic drive system cools the tapping system, in addition to driving the tapping system.

16 Claims, 6 Drawing Sheets

DEVICE FOR OPENING FURNACE TAP HOLES

BACKGROUND OF THE INVENTION

Field of the Invention

The invention relates to phosphate reduction furnaces and more specifically to mechanized and remotely controlled tool used to open tap holes on these furnaces. The mechanized tool is a pneumatically-actuated tap hole ramming rod mechanism for remote opening and unclogging of tap holes that allows the by-products of slag and ferrophosphorus to flow out of the furnace during critical production times.

Description of the Prior Art

It is well known and a widespread practice to use a long pipe to bore an opening through the frozen by-products from two tap holes at two different elevations on the furnace. The tap hole is the drain hole through a furnace wall for the removal of the molten by-products of slag or ferrophosphorus from the furnace. Failure to remove the molten slag and ferrophosphorus frequently during a furnace cycle will clog the furnace. A furnace will be provided with a set of tap holes for each type of by-product. Slag, which is less dense than ferrophosphorus, is drained through the higher elevation tap hole. Ferrophosphorus, which is denser than slag is drained through the lower tap hole. It is usual to have an employee responsible for keeping the tap holes open. The employee's job is to break the frozen by-products by repetitively ramming an oxygen lance into and through the accumulating buildup. The lance is an expensive ½ inch to ¾ inch inner diameter pipe that is 20 feet long with oxygen coursing through the pipe. The resultant heat from the combustion of the oxygen melts a hole in the frozen slag or ferrophosphorus, causing it to flow. Once the tap hole is flowing, the flow is maintained with a manual process called "rodding." To rod the tap hole, an employee strokes a long pipe in and out of the flowing tap hole. This breaks-up and releases carbon or graphite lumps that can plug the tap hole. The initial force of starting the rod into the tap hole is significant. Once the rod is rammed into the tap hole, it has to be pulled back before the tip of the rod begins to droop or even melt. The rod has to be pulled out of the tap hole within a minute of insertion if deformation or melting of the rod-tip is to be avoided. Thus, every few minutes during a draw-off the rod has to be inserted and removed from the furnace.

Many expensive oxygen lances are lost during this process, either by maintaining the lance in the furnace for too long of a time, causing damage to the lance, or through regular consumption, as the heat created by the oxygen consumes the lance.

The employee handling the ramming rod is working in a hot and dangerous environment while performing significant work at his furnace rodding station in a mill. Not only are the heat and explosion dangers significant but the repetitive motion of the action result in possible employee injuries. It is expected that this invention will allow the tap hole operation to be performed by air-actuated mechanisms that are controlled remotely and remove the exposure aspect of the tap hole rodding work from the burden of an employee.

SUMMARY OF THE INVENTION

An object of the invention is to have more controlled tap hole opening times and more reliable slag and ferrophosphorus flow for better process control and improved operational efficiency for the furnace and increased safety for workers.

It is another object of the invention is to replace the expensive and consumable oxygen lance with a less expensive lance that lasts longer.

This invention is an apparatus for use in a remote rodding process for clearing tap holes in phosphate reduction furnaces. The apparatus is an air-actuated ram designed to allow the same apparatus to travel two different rail tracks and intersect the furnace at two different elevation points where the tap holes for the slag and ferrophosphorus by-products are located.

It is expected that the mechanized device will be positionable in each of a plurality of positions to service a plurality of tap holes from its mounted location.

DESCRIPTION OF THE PREFERRED EMBODIMENT

Figure 1:
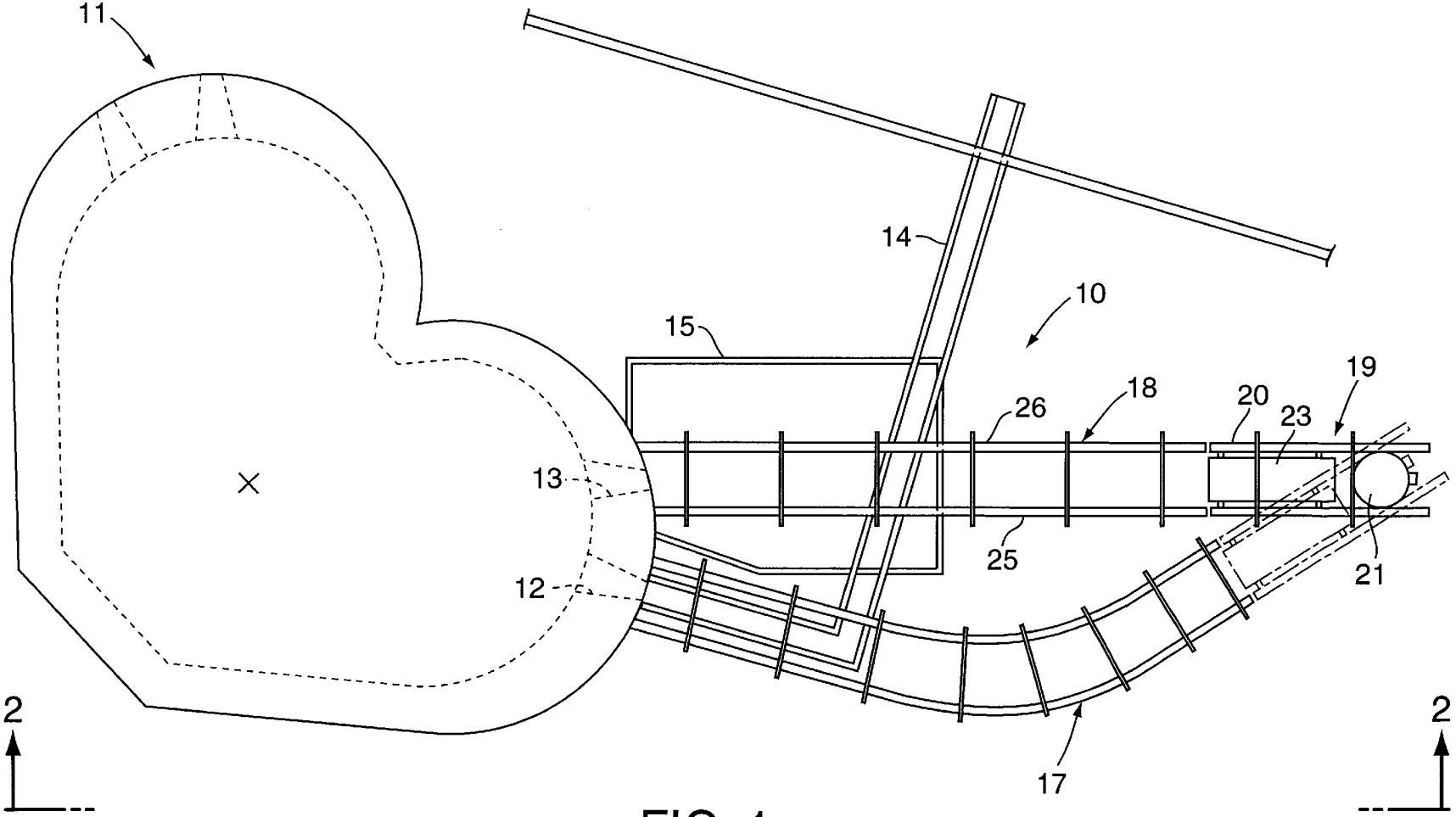
FIG. 1 is a top view of a furnace with the inventive remote tapper system.
Figure 2:
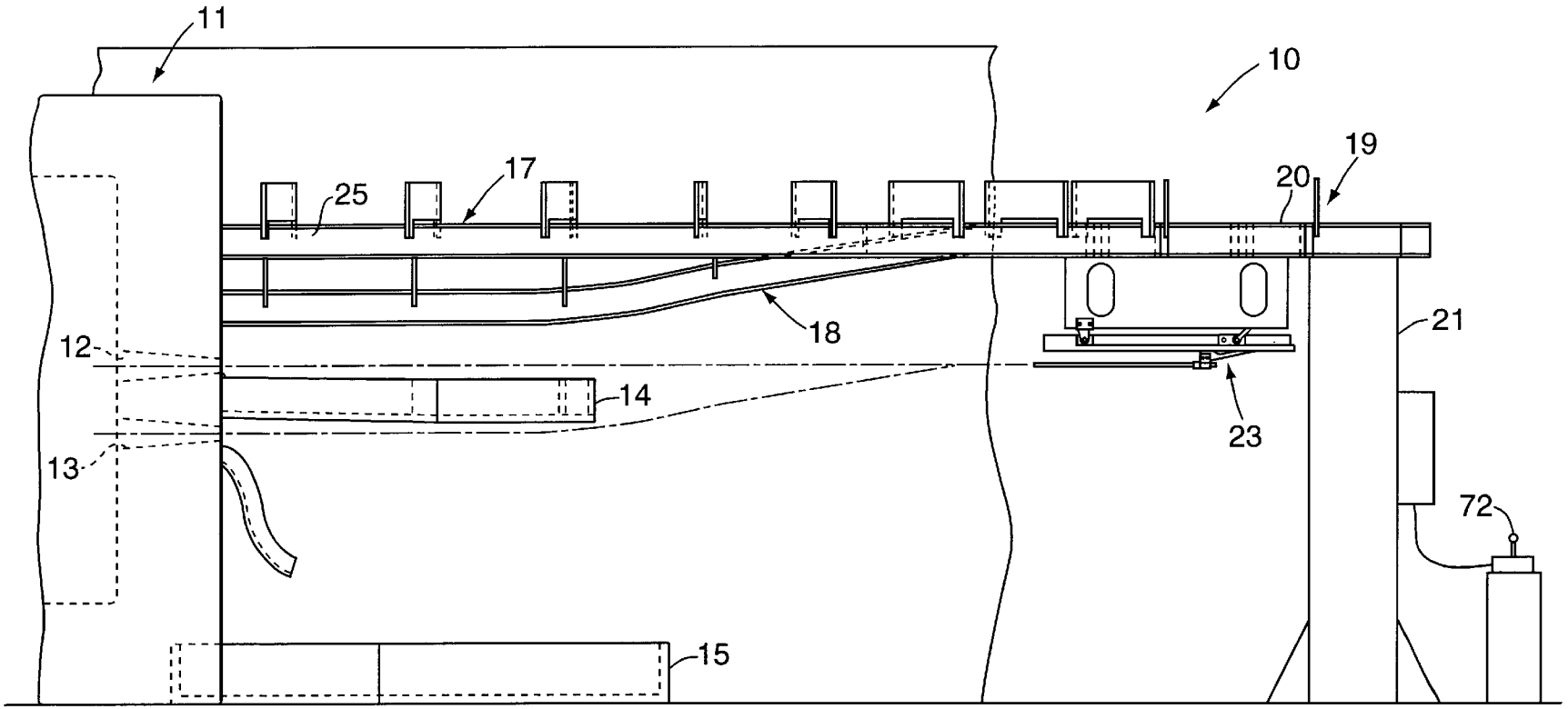
FIG. 2 is a side view of the inventive system shown in FIG. 1 along lines 2—2.

FIG. 1 is a top view of a furnace 11 with the inventive remote tapper system 10. FIG. 2 is a side view of the furnace 11 and remote tapper system 10. The furnace 11 has a slag tap hole 12 and a ferrophosphorus tap hole 13. Below the slag tap hole 12 is a flue 14. Below the ferrophosphorus tap hole 13 is a sand pit 15. Above the slag tap hole 12 is the first end of a first track 17. Above the ferrophosphorus tap hole 13 is a first end of a second track 18. Second ends of the first track 17 and the second track 18 are adjacent to a gantry 19, which comprises a gantry track 20 supported by a rotatable post 21. A carrier 23 is mounted to travel on the first track 17, the second track 18 and the gantry track 20.

Figure 3:
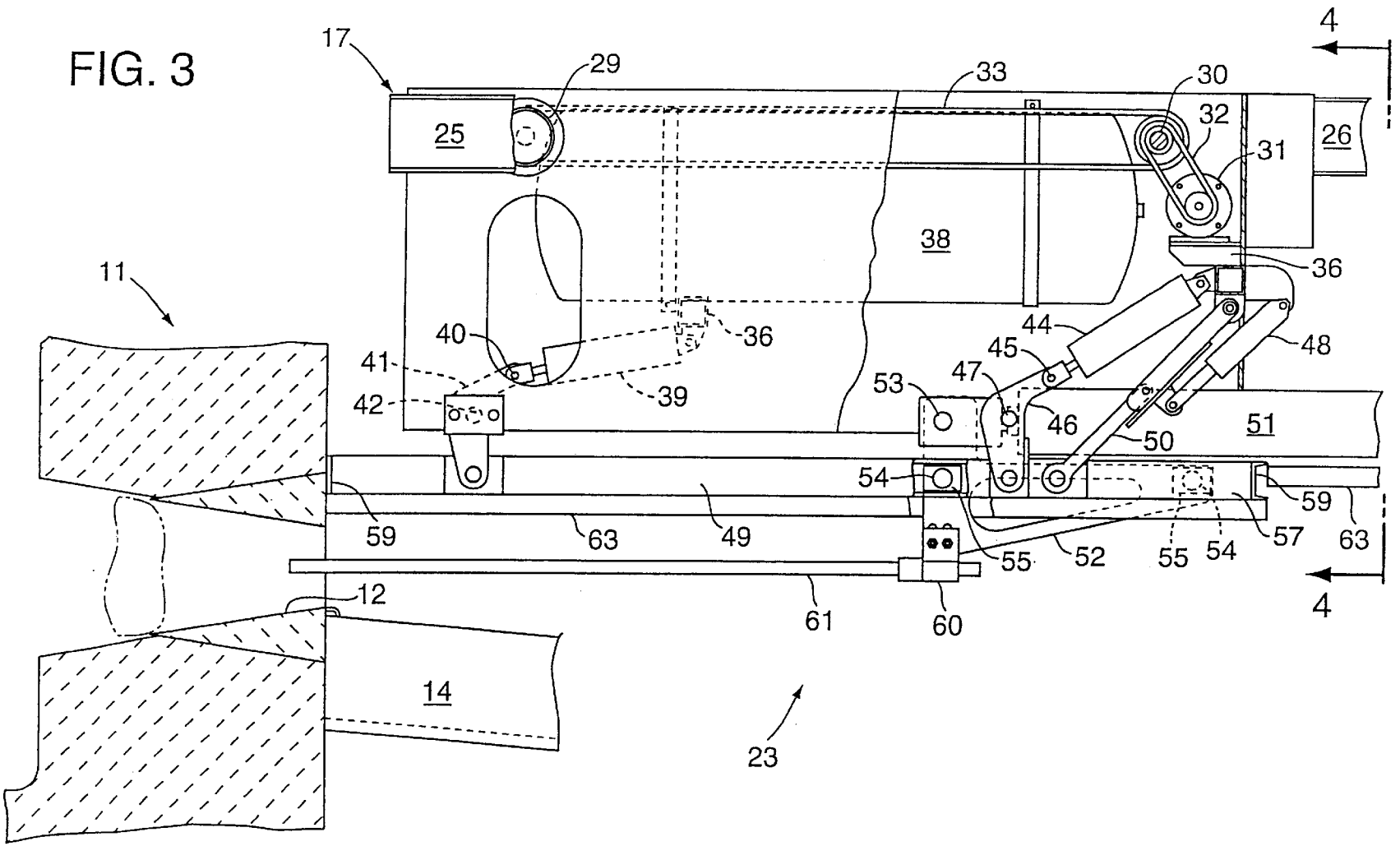
FIG. 3 is enlarged cut away view of the inventive system.
Figure 4:
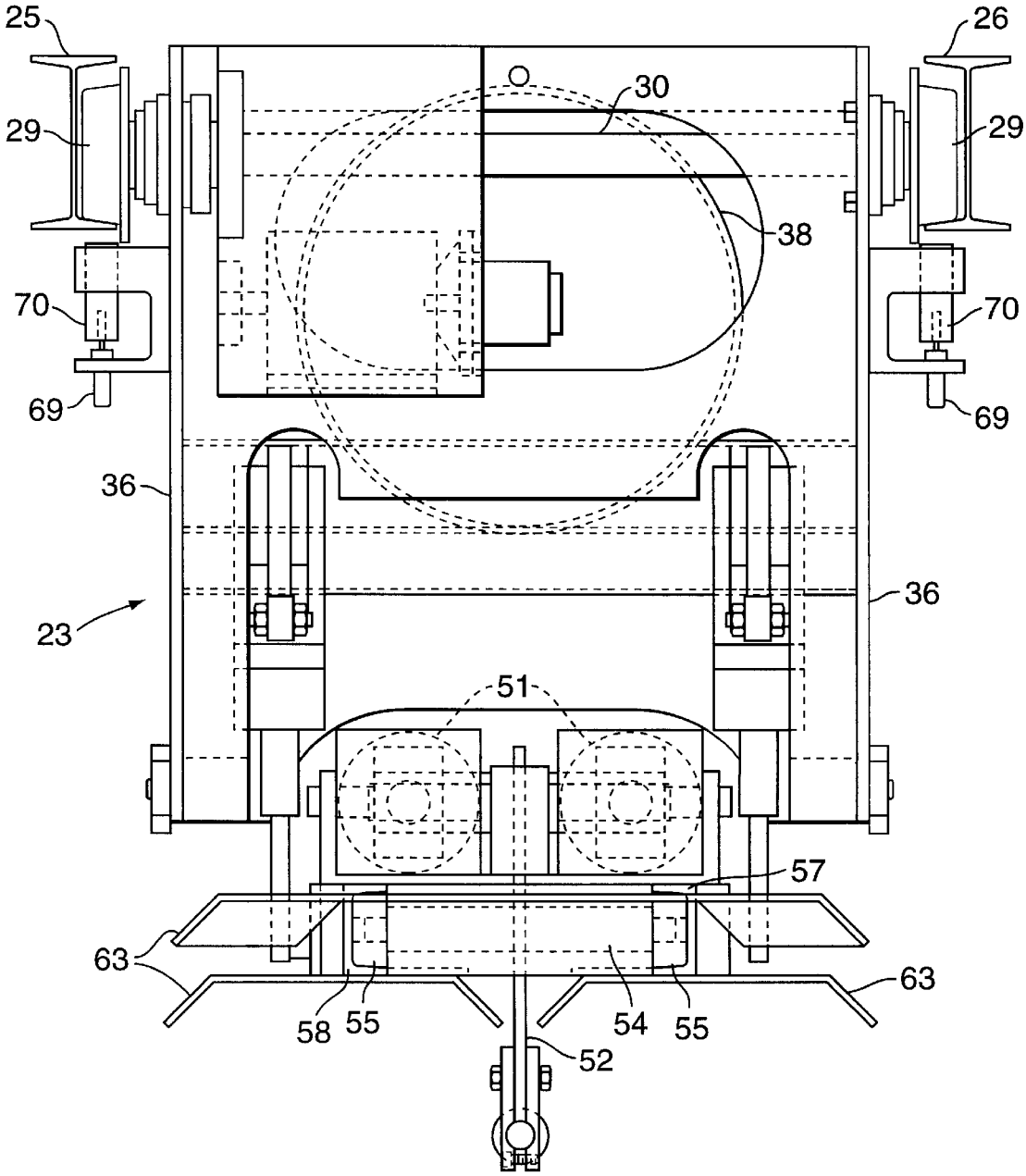
FIG. 4 is an end view of the inventive system shown in FIG. 3 along lines 4—4.

FIG. 3 shows an enlarged cut away view of the carrier 23 near the first end of the first track 17 near the slag tap hole 12. FIG. 4 is an end view of the inventive system shown in FIG. 3, along lines 4—4. The tap hole 12 extends from the outside of the furnace to the inside of the furnace. The first track 17, second track 18, and gantry track 20 comprise a first rail 25 and a second rail 26, with wheel supporting channels. A plurality of wheels 29 are placed in the wheel supporting channels to support the carrier 23. One or more axles 30 extend between pairs of wheels 29. A drive motor 31 is mounted on a carrier frame 36 of the carrier 23. A drive belt 32 is mounted between the drive motor 31 and an axle 30. An axle belt 33 is mounted between two axles 30.

An air tank 38 is mounted on the carrier frame 36. In this embodiment, the volume of the air tank is 80 gallons. First ends of a first set of air cylinders 39 are mechanically connected to the carrier frame 36. Second ends of the first set of air cylinder 39 are mechanically connected by flange pins 40 to first ends of a first set of rotatable flanges 41, which rotate around first shafts 42. Second ends of the first set of rotatable flanges 41 are mechanically connected to a first end of a carriage 49. First ends of a second set of air cylinders 44 are mechanically connected to the carrier frame 36. Second ends of the second set of air cylinders 44 are mechanically connected by flange pins 45 to first ends a second set of rotatable flanges 46, which rotate around second shafts 47. Second ends of the second set of rotatable flanges 46 are mechanically connected to a second end of the carriage 49. A third set of air cylinders 48 are mechanically connected between the carrier frame 36 and the carriage 49 by jointed arms 50.

Barrels of a set of pneumatic ram cylinders 51 are mechanically connected to the carriage 49. Rod eyes of the set of pneumatic ram cylinders 51 are mechanically connected to a sliding bracket 52 by pins 53. A set of block shafts 54 pass through the sliding bracket 52, with bronze sliding blocks 55 at each end of each block shaft 54. A first carriage rail 57 and a second carriage rail 58 enclose the sliding blocks 55 and are tied together by end pieces 59. A lance bracket 60 is used to mechanically connected the lance 61 to the sliding bracket 52. The lance bracket 60 is used to mount the lance 61 to the sliding bracket 52 at a desired angle. Heat shields 63 made from 0.060 inch stainless steel are mechanically connected to the carriage 49.

Barrels of a set of pneumatic brake cylinders 69 are mechanically connected to the carrier frame 36. Rod eyes of the set of pneumatic brake cylinders are mechanically connected to brake blocks 70, which are placed adjacent to the first and second rails 25, 26.

Figure 5:
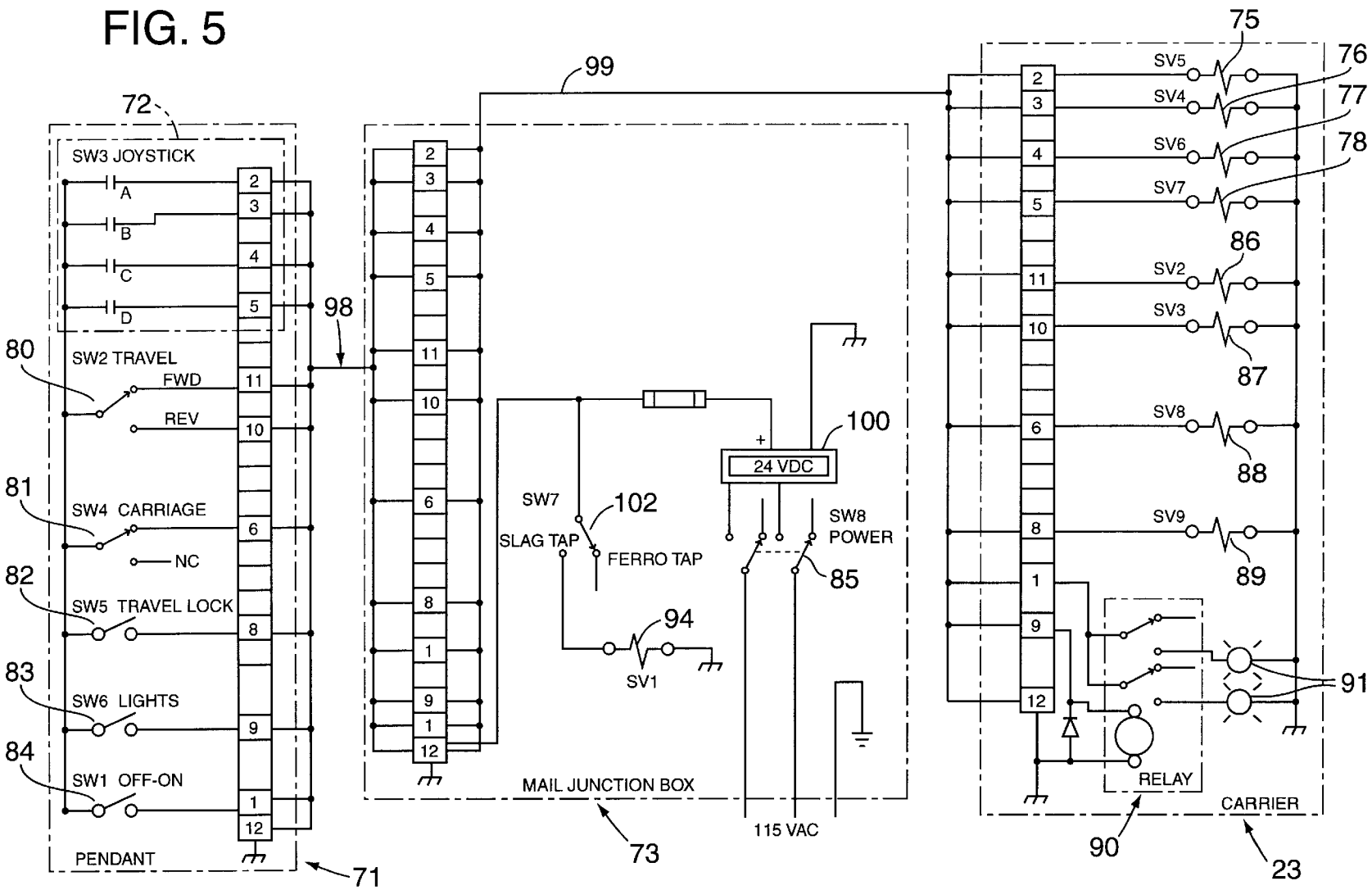
FIG. 5 shows an electrical schematic for the tapper apparatus.

FIG. 5 shows the electrical schematic that allows the deployability of the tapper device from a remotely located joystick pendant 71. The joystick pendant 71 provides directional steering and proportional speed control for the remote tapper system. It is part number 70505K73 and was purchased from the McMaster-Carr catalog. The joystick pendant 71 is electrically connected to a mail junction box 73, by a first multiconductor cable 98. The mail junction box 73 is electrically connected to the carrier 23 by a second multiconductor cable 99. A joystick switch SW3 72 comprises four switches, labeled A, B, C and D. Switch A is electrically connected through pin 2 of the joy stick pendent 71 and through pin 2 of the mail junction box 73 and through pin 2 of the carrier 23 to solenoid valve SV5 75. Switch B is electrically connected through pin 3 of the joy stick pendent 71 and through pin 3 of the mail junction box 73 and through pin 3 of the carrier 23 to solenoid valve SV4 76. Switch C is electrically connected through pin 4 of the joy stick pendent 71 and through pin 4 of the mail junction box 73 and through pin 4 of the carrier 23 to solenoid valve SV6 77. Switch D is electrically connected through pin 5 of the joy stick pendent 71 and through pin 5 of the mail junction box 73 and through pin 5 of the carrier 23 to solenoid valve SV7 78. Right below these four switches are five on-off industrial switches SW2 80, SW4 81, SW5 82, SW6 83, and SW1 84. The switch labeled SW2 Travel Fwd Rev 80 is electrically connected through pins 10 and 11 of the joy stick pendent 71 and through pins 10 and 11 of the mail junction box 73 and through pins 10 and 11 of the carrier 23 to solenoid valves SV2 86 and SV3 87 for the function of forward or reverse travel. The switch labeled SW4 81 is electrically connected through pin 6 of the joy stick pendent 71 and through pin 6 of the mail junction box 73 and through pin 6 of the carrier 23 to solenoid valve SV8 88 for carriage up or down movement. The switch labeled SW5 Travel Lock 82 is electrically connected through pin 8 of the joy stick pendent 71 and through pin 8 of the mail junction box 73 and through pin 8 of the carrier 23 to solenoid valve SV9 89 for locking the mechanized tapper carriage in place. The switch labeled SW6 83 is electrically connected through pin 9 of the joy stick pendent 71 and through pin 9 of the mail junction box 73 and through pin 9 of the carrier 23 to a 24 volt relay 90 to actuate the two lights 91 at the front of the carriage 49. SW1 off-on switch 84 is the key switch, which functions both to prevent unauthorized operation of the apparatus and to energize all of the switches SW3, SW2, SW4, SW5, SW6 and SW1. In the preferred embodiment the second multiconductor cable are multiple polytetrafluoroethylene (PTFE)-coated, high temperature wires. A 24 volt DC power supply 100 is directly connected to a switch labeled SW7 Slag Tap Ferro Tap 102 which is electrically connected to solenoid valve SV1 94.

Figure 6:
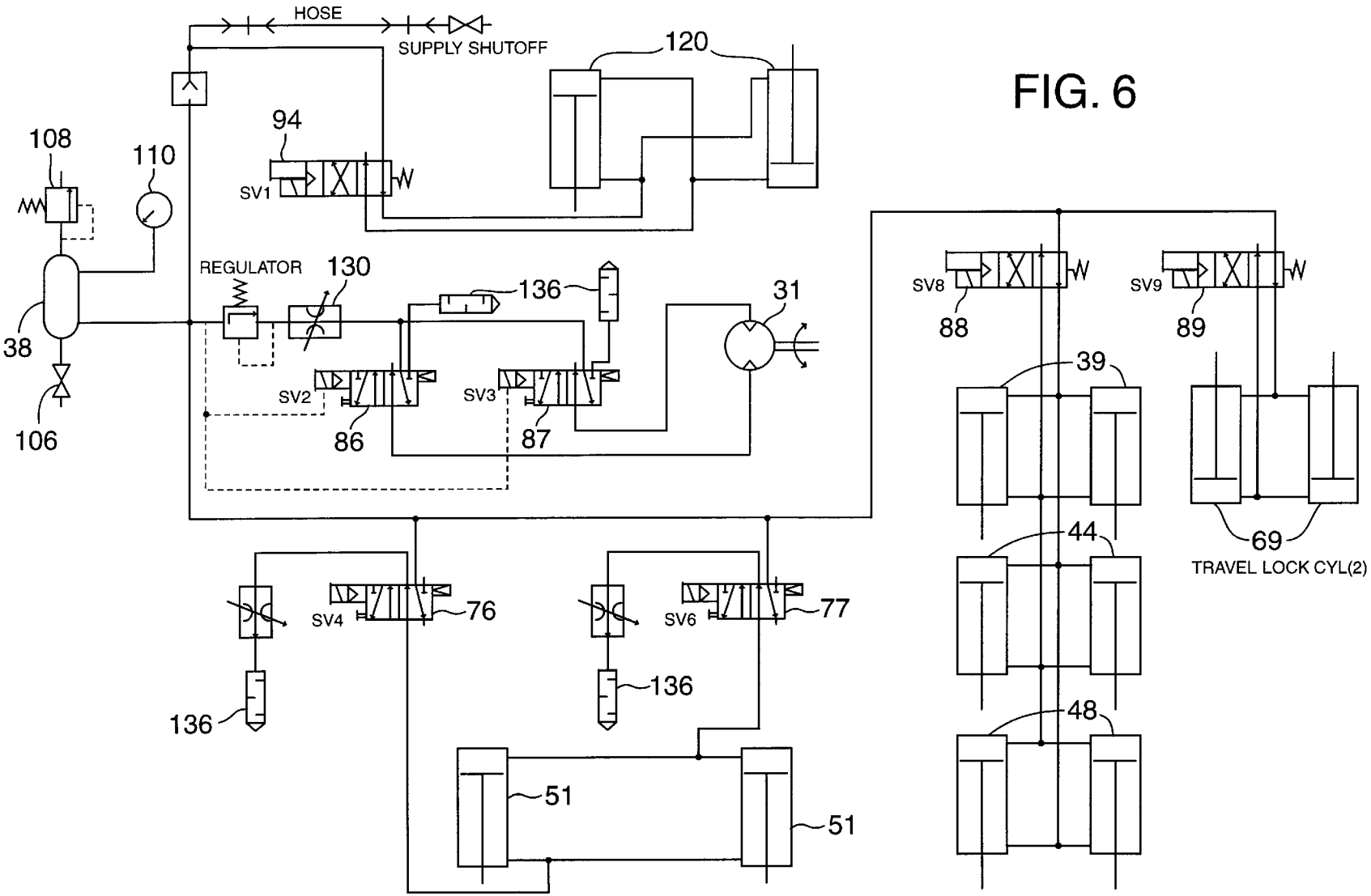
FIG. 6 is the tapper system pneumatic schematic.

FIG. 6 is the tapper system pneumatic schematic. The air tank 38 is in fluid connection with a drain 106, a relief valve 108 and a pressure gauge 110, the solenoid valve SV1 94, the solenoid valve SV2 86, the solenoid valve SV3 87, the solenoid valve SV8 88, the solenoid valve SV9 92, the solenoid valve SV4 76, and the solenoid valve SV6 77. The pneumatic solenoid valves in some embodiments may be part number 168SCS-145-121-E purchased from Kay Pneumatics. Solenoid valves SV2 and SV3 86, 87 are connected to an adjustable orifice 130 which adjusts the travel speed and to the drive motor 31. The drive motor 31 is part number KM82 from Fenner Fluid Power. There are four mufflers 136 in this embodiment. The mufflers are used to dampen sound and to serve as a vent to the atmosphere. These mufflers, part number AS-5311-3M, were purchased from Fauver.

In operation, the furnace 11 creates molten slag and heavier molten ferrophosphorus. The slag is drained through the slag tap hole 12, and the ferrophosphorus is drained through the ferrophosphorus tap hole 13. Because the slag is less dense than the ferrophosphorus, the slag tap hole 12 is at a higher elevation that the ferrophosphorus tap hole 13. The ferrophosphorus is drained to the sand pit 15, creating large slugs which are sold. The slag is caught by the flue 14 and directed outside the building, where it is loaded on to railroad cars for disposal. After a period of time, which may be around 30 minutes, the tap holes become clogged and need tapping to reopen the tap holes. Switch SW8 85 is set to provide power to the remote tapper system 10. Switch SW1 84 is set to the on position to allow the control switches to control the remote tapper system 10. Switch SW6 83 is set to the on position to turn on the lights 91.

If the carrier 23 is located on the gantry track 20 and the gantry track 20 is adjacent to the second end of the second track 18, as shown in FIG. 1, then switch SW7 102 is set from a Ferro Tap setting to a Slag Tap setting. This causes solenoid valve SV 194 to go from a Ferro Tap setting to a Slag Tap setting, which causes an actuator to rotate the rotatable post 21 to move the gantry track 20 to a position adjacent to the second end of the first track 17 as shown in phantom lines in FIG. 1. Switch SW2 80 is set on the "forward" setting causing solenoid valves SV2 and SV3 86, 87 to be set in the "forward" setting, causing the drive motor 31 to rotate in a forward direction. The drive motor 31 drives the drive belt 32 in the forward direction, which drives a driven axle 30 in the forward direction. The driven axle 30 drives the axle belt 33 in a forward direction. As a result, all of the wheels 29 are driven in a forward direction, moving the carriage 23 towards the furnace 11. FIG. 3 shows the carrier 23 adjacent to the furnace 11 on the first track 17, adjacent to the slag tap hole 12, where the carrier 23 stops. Switch SW5 82 is then closed causing solenoid valve SV9 89 to move to the cross connect position, allowing air into the blind end of the brake cylinders 69 causing the brake cylinders to extend pushing brake blocks 70 against the first and second rails 25, 26. Switch SW4 81 is set to carriage, which causes solenoid valve SV8 88 to move to allow direct flow through, allowing air into the blind ends of the first set of air cylinders 39 and the second set of air cylinders 44, while allowing air into the rod end of the third set of air cylinders 48. This causes the first set of air cylinders 39 and the second set of air cylinders 44 to extend while the third set of air cylinders 48 contract, causing the first set of rotatable flange 41 and the second set of rotatable flanges 46 to rotate, causing the carriage 49 to move downward. The third set of air cylinders 48 lock the jointed arms 50 in place, thus locking the carriage 49 in place. The downward movement of the carriage 49 aligns the lance 61 with the slag tap hole 12. The joystick is then pushed forward, causing switch B to close and switch C to open, causing solenoid valves SV4 and SV6 76,77 to move so that air pressure is directed into the rod ends of the set of ram cylinders 51. A fail safe is established that only allows solenoid valves SV4 and SV6 76, 77 to move only when the brake cylinders 69 are extended. The ram cylinders 51 push the sliding bracket 52 towards the furnace 11. The sliding bracket 52 slides with the sliding blocks 55 in the first and second carriage rails 57, 58 guiding the sliding bracket 52. The movement of the sliding bracket 52 towards the furnace 11 pushes the lance 61 into the slag tap hole 12. In the prior art, an expensive oxygen lance was required, to melt the slag build up in the slag tap hole, because the operator could not manually place a great force on the lance. The force of the ram cylinders 51 is great enough so than an inexpensive solid metal lance using the force of the ram cylinders 51 alone is used to remove slag build up in the slag tap hole 12. The ability to apply great force with the ram cylinders 51 also removes the need for rodding the slag tap hole. The heat shields 63 prevent the heat from the furnace from damaging the remote tapper system 11. Air being vented from the pneumatic system provides cooling and additional protection from the furnace heat.

After the slag tap hole 12 is reopened, the joystick is then pushed back, causing switch B to open and switch C to close, causing solenoid valves SV4 and SV6 76,77 to move so that air pressure is directed into the blind ends of the set of ram cylinders 51. The ram cylinders 51 contract pulling the sliding bracket 52 away from the furnace 11. The movement of the sliding bracket 52 away from the furnace 11 pulls the lance 61 out of the slag tap hole 12. Switch SW4 81 is set to NC, which causes solenoid valve SV8 88 to move to allow cross flow through, allowing air into the rod ends of the first set of air cylinders 39 and the second set of air cylinders 44, while allowing air into the blind end of the third set of air cylinders 48. This causes the first set of air cylinders 39 and the second set of air cylinders 44 to contract while the third set of air cylinders 48 extends and unlocks the jointed arms 50, causing the first set of rotatable flange 41 and the second set of rotatable flanges 46 to rotate, causing the carriage 49 to move upward. The upward movement of the carriage 49 allows the carriage to move over a ledge of the flue 14 without hitting the ledge of the flue 14. Switch SW2 80 is set on the "reverse" setting causing solenoid valves SV2 and SV3 86, 87 to be set in the "reverse" setting, causing the drive motor 31 to rotate in a reverse direction. The drive motor 31 drives the drive belt 32 in the reverse direction, which drives a driven axle 30 in the reverse direction. The driven axle 30 drives the axle belt 33 in a reverse direction. As a result, all of the wheels 29 are driven in a reverse direction, moving the carriage 23 away from the furnace 11 and onto the gantry track 21.

If the ferrophosphorus tap hole 13 becomes plugged, then switch SW7 102 is set from a Slag Tap setting to a Ferro Tap setting. This causes solenoid valve SV1 to go from a Slag Tap setting to a Ferro Tap setting, which causes an actuator to rotate the rotatable post 21 to move the gantry track 20 to a position adjacent to the second end of the second track 18 as shown in FIG. 1. Switch SW2 80 is set on the "forward" setting causing solenoid valves SV2 and SV3 86, 87 to be set in the "forward" setting, causing the drive motor 31 to rotate in a forward direction. The drive motor 31 drives the drive belt 32 in the forward direction, which drives a driven axle 30 in the forward direction. The driven axle 30 drives the axle belt 33 in a forward direction. As a result, all of the wheels 29 are driven in a forward direction, moving the carriage 23 towards the furnace 11 adjacent to the ferrophosphorus tap hole 13, where the carrier 23 stops. Switch SW5 82 is then closed causing solenoid valve SV9 89 to move to the cross connect position, allowing air into the blind end of the brake cylinders 69 causing the brake cylinders to extend pushing brake blocks 70 against the first and second rails 25, 26. Switch SW4 81 is set to carriage, which causes solenoid valve SV8 88 to move to allow direct flow through, allowing air into the blind ends of the first set of air cylinders 39 and the second set of air cylinders 44, while allowing air into the rod end of the third set of air cylinders 48. This causes the first set of air cylinders 39 and the second set of air cylinders 44 to extend while the third set of air cylinders 48 to contract, causing the first set of rotatable flange 41 and the second set of rotatable flanges 46 to rotate, causing the carriage 49 to move downward. The downward movement of the carriage 49 aligns the lance 61 with the ferrophosphorus tap hole 13. The joystick is then pushed forward, causing switch B to close and switch C to open, causing solenoid valves SV4 and SV6 76,77 to move so that air pressure is directed into the rod ends of the set of ram cylinders 51. A fail safe is established that only allows solenoid valves SV4 and SV6 76, 77 to move only when the brake cylinders 69 are extended. The ram cylinders 51 push the sliding bracket 52 towards the furnace 11. The sliding bracket 52 slides with the sliding blocks 55 in the first and second carriage rails 57, 58 guiding the sliding bracket 52. The movement of the sliding bracket 52 towards the furnace 11 pushes the lance 61 into the ferrophosphorus tap hole 13. The force of the ram cylinders 51 is great enough so than an inexpensive solid metal lance using the force of the ram cylinders 51 alone is used to remove ferrophosphorus build up in the ferrophosphorus tap hole 13. The ability to apply great force with the ram cylinders 51 also removes the need for rodding the ferrophosphorus tap hole.

After the ferrophosphorus tap hole 13 is reopened, the joystick is then pushed back, causing switch B to open and switch C to close, causing solenoid valves SV4 and SV6 76,77 to move so that air pressure is directed into the blind ends of the set of ram cylinders 51. The ram cylinders 51 contract pulling the sliding bracket 52 away from the furnace 11. The movement of the sliding bracket 52 away from the furnace 11 pulls the lance 61 out of the ferrophosphorus tap hole 13. Switch SW4 81 is set to NC, which causes solenoid valve SV8 88 to move to allow cross flow through, allowing air into the rod ends of the first set of air cylinders 39 and the second set of air cylinders 44, while allowing air into the blind end of the third set of air cylinders 48. This causes the first set of air cylinders 39 and the second set of air cylinders 44 to contract while the third set of air cylinders 48 to extends, causing the first set of rotatable flange 41 and the second set of rotatable flanges 46 to rotate, causing the carriage 49 to move upward. Switch SW2 80 is set on the "reverse" setting causing solenoid valves SV2 and SV3 86, 87 to be set in the "reverse" setting, causing the drive motor 31 to rotate in a reverse direction. The drive motor 31 drives the drive belt 32 in the reverse direction, which drives a driven axle 30 in the reverse direction. The driven axle 30 drives the axle belt 33 in a reverse direction. As a result, all of the wheels 29 are driven in a reverse direction, moving the carriage 23 away from the furnace 11 and onto the gantry track 21.

In summary, in a simple embodiment of the invention, the current practices of tapping furnace tap holes with a manually operated oxygen lance and the maintenance of such flow with an operator stroking a long pipe in and out of the flowing tap hole are replaced with an automated ramming apparatus, preferably air-actuated in order to eliminate the use of any hydraulic fluids and the danger of autocombustion with pure oxygen that its use entails, positionable in each of a plurality of positions to service numerous tap hole locations from its mounted location. This results in more controlled tap hole opening times and more stable slag levels. On the industrial hygiene front, exposure of the human operator to the bums and heat exhaustion possible from the temperature extremes and the cumulative trauma of the upper extremities due to repetitive motion is eliminated. In addition, expensive oxygen lances which are consumed by the heat they produce, are replaced with inexpensive solid metal lances, which do not generate heat, and therefore are not similarly consumed.

Although the best mode contemplated for carrying out the present invention has been herein shown and described, it will be understood that modification and variation may be made without departing from what is regarded to be the subject matter of the invention.

What is claimed is:

1. An apparatus for opening furnace tap holes, comprising:

a first track adjacent to a first furnace tap hole;

a second track adjacent to a second furnace tap hole; a carrier for moving along said first and second tracks;

a lance mechanically connected to said carrier;

means for propelling said carrier along said first and second tracks: and means for moving said carrier from said first track to said second track.

2. The apparatus according claim 1, further comprising;

means for moving the lance into the first furnace tap hole; and means for remotely controlling the movement of the carrier along the first track and the movement of the lance.

3. The apparatus according to claim 2, wherein said means for moving the lance comprises a first pneumatic cylinder, wherein the first pneumatic cylinder provides cooling to the apparatus.

4. The apparatus according to claim 3, further comprising:

a brake to prevent the movement of the carrier along the first track;

a first safety interlock that prevents the moving of the lance when the brake is not set; and a second safety interlock that prevents the moving of the lance, when the carrier is not in a set position.

5. The apparatus, according to claim 4, further comprising a third safety interlock, which prevents movement of the means for moving the carrier from the first track to the second track, when power is not supplied to the apparatus.

6. The apparatus, according to claim 3, wherein the means for moving the carrier from the first track to the second track, comprises a gantry.

7. The apparatus, according to claim 3, wherein the means for remotely controlling the movement of the carrier, comprises:

a joystick pendant; and a high temperature multiconductor cable electronically connected to the carrier.

8. The apparatus, according to claim 7, wherein said multiconductor cable comprises polytetrafluoroethylene (PTFE)-coated, high temperature wires.

9. The apparatus, according to claim 3, wherein the lance is a solid metallic bar.

10. The apparatus according claim 1, further comprising:

means for moving the lance into the first furnace tap hole; and means for remotely controlling the movement of the carrier along the first track and the movement of the lance.

11. The apparatus according to claim 10, wherein said means for moving the lance comprises a first pneumatic cylinder, wherein the first pneumatic cylinder provides cooling to the apparatus.

12. The apparatus according to claim 11, further comprising:

a brake to prevent the movement of the carrier along the first track;

a first safety interlock that prevents the moving of the lance when the brake is not set; and a second safety interlock that prevents the moving of the lance, when the carrier is not in a set position.

13. The apparatus, according to claim 12, wherein the means for moving the carrier from the first track to the second track, comprises a gantry.

14. The apparatus, according to claim 13, wherein the means for remotely controlling the movement of the carrier, comprises:

a joystick pendant; and a high temperature multiconductor cable electronically connected to the carrier.

15. The apparatus, according to claim 10, wherein the lance is a solid metallic bar.

16. The apparatus, according to claim 15, further comprising a means for raising and lowering the lance, mechanically connected between the lance and the carrier.

* * * * *